US007566211B2

(12) United States Patent
Nishikata et al.

(10) Patent No.: US 7,566,211 B2
(45) Date of Patent: Jul. 28, 2009

(54) VANE PUMP HAVING VANES WITH A CUTOUT PORTION

(75) Inventors: Masaaki Nishikata, Fukuoka (JP); Tsuyoshi Kusakabe, Chikushi (JP); Tsukasa Hojo, Hirakata (JP); Ken Yamamoto, Osaka (JP); Masaki Nagano, Ibaraki (JP)

(73) Assignee: Matsushita Electric Works, Ltd., Osaka (JP)

( * ) Notice: Subject to any disclaimer, the term of this patent is extended or adjusted under 35 U.S.C. 154(b) by 0 days.

(21) Appl. No.: 11/984,130

(22) Filed: Nov. 14, 2007

(65) Prior Publication Data

US 2008/0118384 A1 May 22, 2008

(30) Foreign Application Priority Data

Nov. 21, 2006 (JP) ..... 2006-314629

(51) Int. Cl.
*F03C 4/00* (2006.01)
*F04C 2/00* (2006.01)

(52) U.S. Cl. ..... 418/259; 418/146; 418/238; 418/268

(58) Field of Classification Search ..... 418/259, 418/266–268, 237, 248, 249, 145, 146, 236, 418/238

See application file for complete search history.

(56) References Cited

U.S. PATENT DOCUMENTS 1,543,155 A 6/1925 Fradet
1,965,388 A * 7/1934 Ott ..... 418/269
4,163,635 A * 8/1979 Sakamaki et al. ..... 418/236
4,174,931 A 11/1979 Ishizuka
4,867,658 A * 9/1989 Sugita et al. ..... 418/268
6,030,191 A 2/2000 Wood et al.

FOREIGN PATENT DOCUMENTS

| | | |
|---|---|---|
| CN | 1276852 | 12/2000 |
| GB | 1 537 522 | 12/1978 |
| JP | 55161989 A * | 12/1980 |
| JP | 57-137680 | 8/1982 |
| JP | 61-011401 | 1/1986 |
| JP | 61-87987 | 5/1986 |
| JP | H62-291488 | 12/1987 |
| JP | 2006-194090 | 7/2006 |

* cited by examiner

*Primary Examiner*—Theresa Trieu
(74) *Attorney, Agent, or Firm*—Bacon & Thomas, PLLC

(57) ABSTRACT

A vane pump includes a rotor chamber; a rotor accommodated in the rotor chamber; a plurality of vanes attached to the rotor, each vane having a leading end adapted to make sliding contact with an inner peripheral surface of the rotor chamber. The vane pump includes working compartments surrounded by inner surfaces of the rotor chamber, an outer peripheral surface of the rotor and the vanes; an inlet port through which a working fluid is drawn into a working compartment; and an outlet port through which the working fluid is discharged from a working compartment. A cutout portion is formed in a leading end portion of each vane on each of at least one of a leading and a trailing side of the leading end portion, the leading end of each vane having a width smaller than that of a base end portion of each vane.

4 Claims, 6 Drawing Sheets

VANE PUMP HAVING VANES WITH A CUTOUT PORTION

FIELD OF THE INVENTION

The present invention relates to a vane pump.

BACKGROUND OF THE INVENTION

Typical vane pumps known in the art include, e.g., the one illustrated in FIG. 8. This vane pump 1 has a rotor chamber 2 and a rotor 3 eccentrically accommodated in the rotor chamber 2. A plurality of vane grooves 19 is radially formed in the rotor 3 and vanes 4 are slidably moved in the respective vane grooves 19. Each of the vanes 4 is free to move in a radial direction of the rotor 3. As the rotor 3 is rotatably driven, the leading ends of the respective vanes 4 make sliding contact with the inner peripheral surface 2*a* of the rotor chamber 2, whereby working compartments 5 surrounded by inner surfaces of the rotor chamber 2, an outer peripheral surface 3*a* of the rotor 3 and the vanes 4 undergo a volume change and a working fluid drawn into the working compartments 5 from an inlet port 6 is discharged through an outlet port 7. As an example, Japanese Patent Laid-Open Application No. H 62-291488 discloses the same vane pump as the one illustrated in FIG. 8.

In such a vane pump, each of the vanes 4 needs to have a relatively great width W (a dimension in the direction perpendicular to a length or protruding direction P of the vane 4 when viewed in a thrust direction, i.e., axial direction, of the rotor 3) in order to increase the strength thereof and also to make itself less susceptible to a dimensional error of the vanes 4 and the vane grooves 19 to thereby assure stable movement of the vanes 4 in a radial direction of the rotor 3.

The width W of each of the vanes 4 needs to be uniform not to vary depending on the locations in the length direction thereof for stable movement in the vane groove 19. For this reason, if the width of the vanes 4 is increased as noted above, it becomes difficult for the leading ends of the vanes 4 to make close sliding contact with the inner peripheral surface 2*a* of the rotor chamber 2 having a circular cross section. Thus, the working fluid is apt to be leaked through the gaps between the inner peripheral surface 2*a* of the rotor chamber 2 and the leading ends of the vanes 4. Consequently, pump efficiency is deteriorated.

SUMMARY OF THE INVENTION

In view of the above, the present invention provides a vane pump capable of not only increasing the strength of vanes and assuring stable movement of the vanes in a radial direction of a rotor but also bringing leading ends of the vanes into close sliding contact with an inner peripheral surface of a rotor chamber to thereby improve pump efficiency.

In accordance with an embodiment of the present invention, there is provided a vane pump, including: a rotor chamber; a rotor accommodated in the rotor chamber; a plurality of vanes attached to the rotor, each of the vanes having a leading end adapted to make sliding contact with an inner peripheral surface of the rotor chamber; working compartments surrounded by inner surfaces of the rotor chamber, an outer peripheral surface of the rotor and the vanes, the working compartments adapted to undergo a volume change as the rotor is rotatably driven; an inlet port through which a working fluid is drawn into a working compartment whose volume is being increased; and an outlet port through which the working fluid is discharged from a working compartment whose volume is being decreased, wherein a cutout portion is formed in a leading end portion of each of the vanes on each of at least one of a leading and a trailing side of the leading end portion as viewed in a rotating direction of the rotor, the leading end of each of the vanes having a width smaller than that of a base end portion of each of the vanes.

Preferably, the width of the leading end of each of the vanes has a width smaller than that of the cutout portion.

Preferably, a cutout portion is formed in a leading end portion of each of the vanes on a trailing side of the leading end portion as viewed in a rotating direction of the rotor.

Preferably, the cutout portion is of a flat slant surface or a smoothly curved surface.

Preferably, the cutout portion is contiguous to the leading end and is parallel to a thrust direction of the rotor.

Preferably, the cutout portion includes a plurality of slant surfaces arranged parallel to a thrust direction of the rotor, such that the closer to the leading end of each of the vanes the slant surfaces lie, the greater inclination angle the slant surfaces make with respect to a protruding direction of each of the vanes.

Preferably, the cutout portion is formed only on the trailing side of the leading end portion of each of the vanes.

Preferably, each of the vanes has a beveled portion formed by chamfering a leading side end corner of each of the vanes as viewed in the rotating direction of the rotor.

In the vane pump described above, a cutout portion is formed in the leading end portion of each of the vanes on each of at least one of the leading and the trailing side of the leading end portion as viewed in the rotating direction of the rotor and the leading end of each of the vanes has a width smaller than that of a base end portion of each of the vanes. Therefore, the base end portion of each of the vanes can be made to have a large width, which makes it possible to increase the strength of the vanes and to make the vanes less susceptible to a dimensional error of themselves and the vane grooves, thereby assuring stable movement of the vanes in the radial direction of the rotor. Furthermore, the leading end of each of the vanes having a reduced width can be brought into close contact with the inner peripheral surface of the rotor chamber having a circular cross section, which helps improve pump efficiency.

Moreover, in the vane pump described above, a beveled portion is formed by cutting the leading side corner of the leading end portion of each of the vanes as viewed in the rotating direction of the rotor. This makes it possible to bring the leading end of each of the vanes into closer sliding contact with the inner peripheral surface of the rotor chamber having a circular cross section and also to reduce the resistance against sliding movement of each of the vanes.

BRIEF DESCRIPTION OF THE DRAWINGS

The objects and features of the present invention will become apparent from the following description of embodiments, given in conjunction with the accompanying drawings, in which.

DETAILED DESCRIPTION OF THE EMBODIMENTS

Hereinafter, embodiments of the present invention will now be described in detail with reference to the accompanying drawings which form a part hereof.

Figure 1:
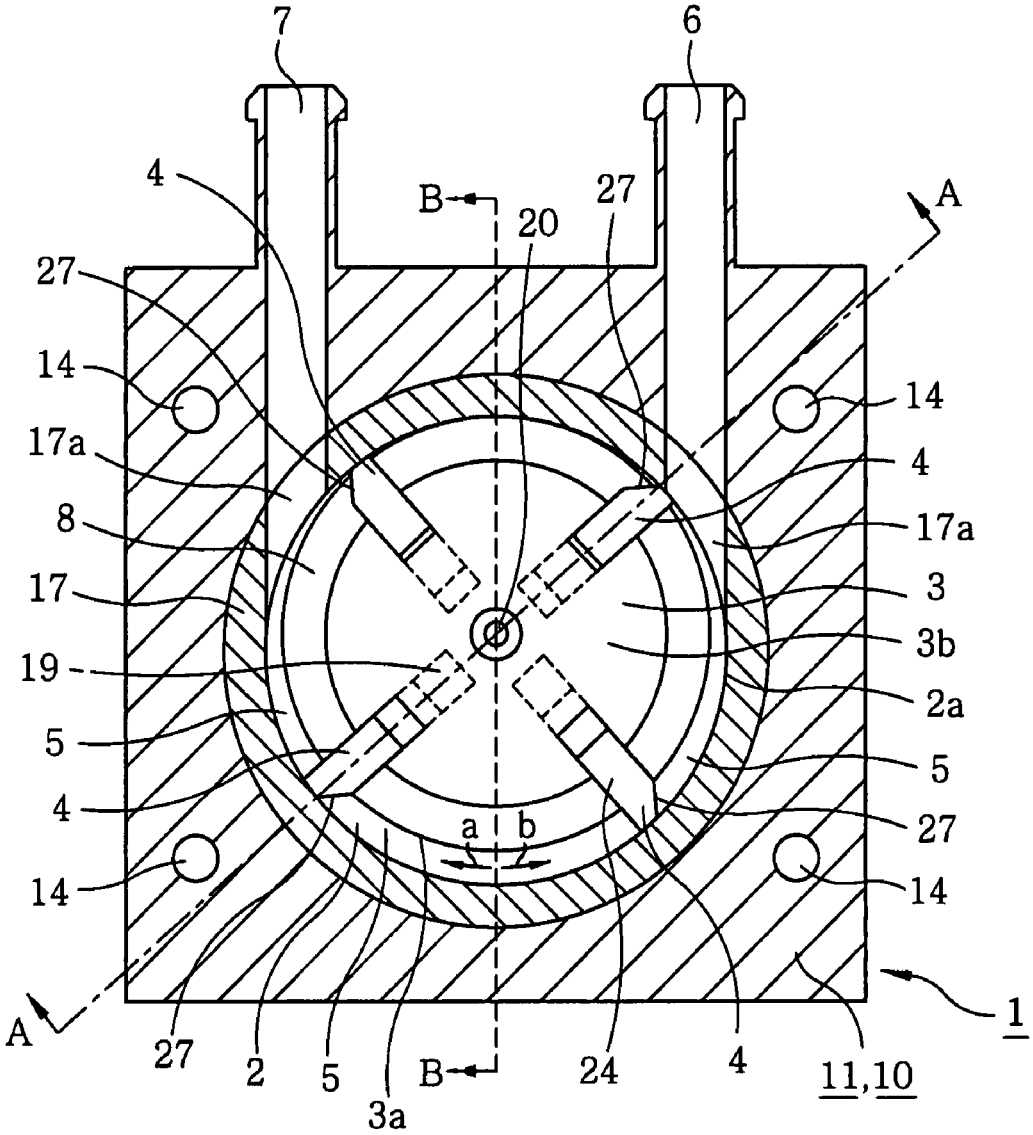
FIG. 1 is a horizontal cross sectional view showing an exemplary vane pump in accordance with one embodiment of the present invention.
Figure 2A:
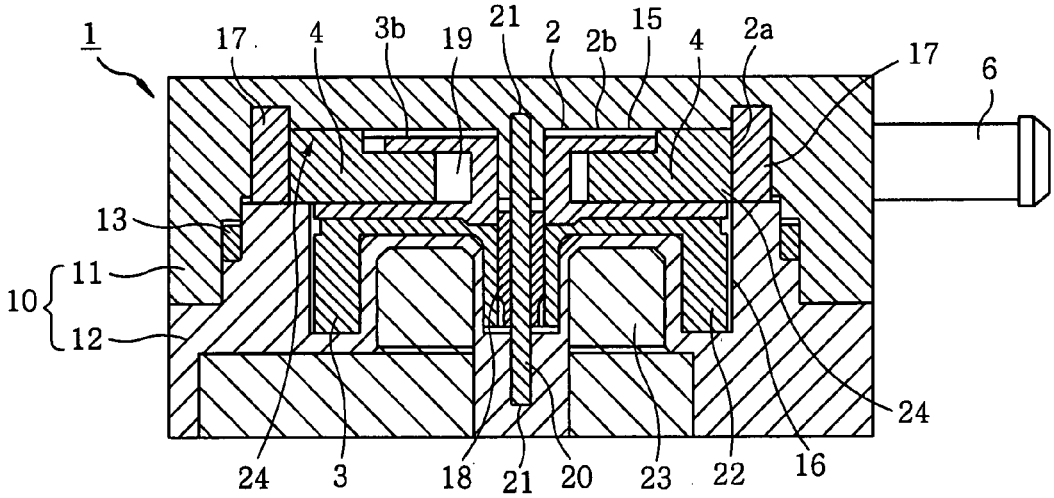
FIGS. 2A and 2B are cross sectional views taken along the lines A-A and B-B in FIG. 1, respectively.
Figure 2B:
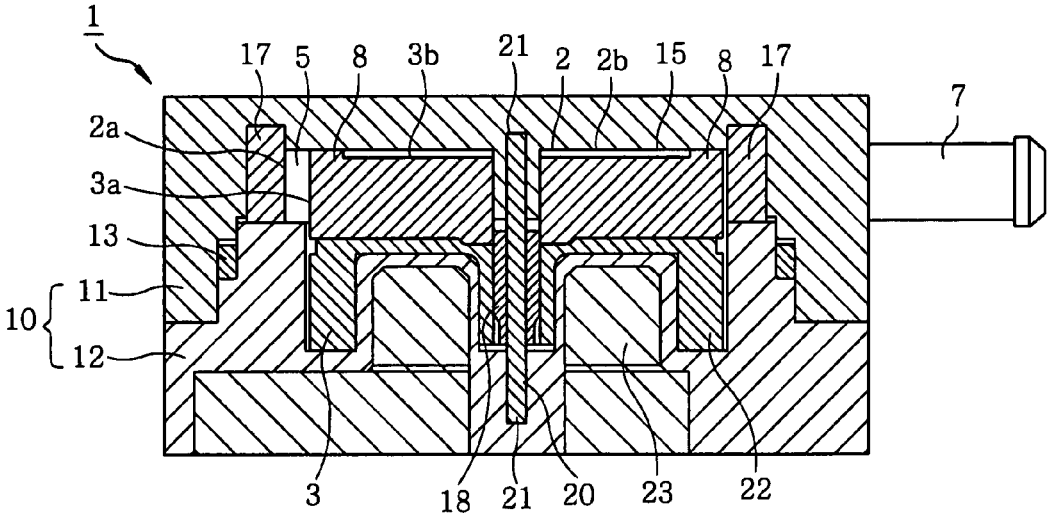
Figure 3:
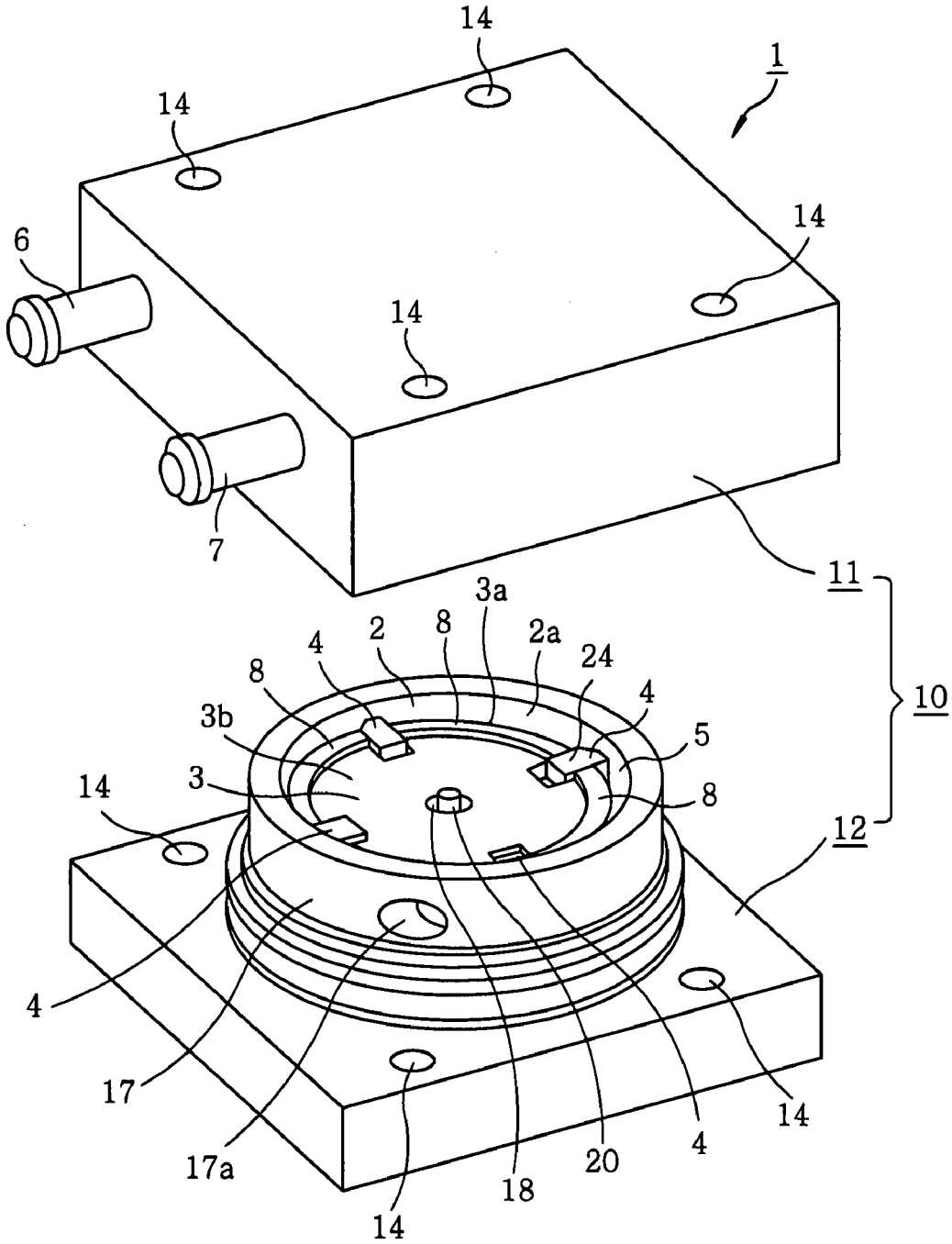
FIG. 3 is an exploded perspective view of the vane pump shown in FIG. 1.

The vane pump 1 shown in FIGS. 1 to 3 in accordance with an embodiment of the present invention includes a casing 10 having a rotor chamber 2 in which a rotor 3 is accommodated eccentrically. A plurality of vanes 4 each having a leading end that makes sliding contact with an inner peripheral surface 2*a* of the rotor chamber 2 is mounted to the rotor 3. The casing 10 is provided with an inlet port 6 and an outlet port 7 leading to the rotor chamber 2. As the rotor 3 is rotatably driven, working compartments 5 surrounded by inner surfaces of the rotor chamber 2, an outer peripheral surface 3*a* of the rotor 3 and the vanes 4 undergo a volume change and a working fluid drawn into the working compartments 5 from the inlet port 6 is discharged through the outlet port 7. Such a configuration of the vane pump 1 will be described in detail hereinbelow.

A thrust direction of the rotor 3 of the embodiment of the present invention runs vertically. The casing 10 that accommodates the rotor 3 therein is formed of an upper case 11 positioned above the rotor 3 and a lower case 12 arranged below the rotor 3, both of which are combined together with a packing 13 interposed therebetween. Reference numeral 14 in FIG. 1 designates fastener holes through which fasteners are inserted to couple the upper case 11 and the lower case 12 together. The upper case 11 has an upper recess 15 upwardly recessed from a coupling surface thereof coupled to the lower case 12. The lower case 12 has a lower recess 16 downwardly recessed from a coupling surface thereof coupled to the upper case 11. The upper recess 15 and the lower recess 16 are combined together to form the rotor chamber 2.

The rotor 3 has an upper portion positioned in the upper recess 15 and a lower portion lying in the lower recess 16. The upper recess 15 has an inner diameter greater than an outer diameter of the rotor 3, and the lower recess 16 has an inner diameter substantially the same as the outer diameter of the rotor 3. In other words, the lower recess 16 is formed to have an inner diameter smaller than that of the upper recess 15, so that, when the upper case 11 and the lower case 12 are combined together, the lower recess 16 is positioned eccentrically from the upper recess 15 just like the rotor 3. A ring member 17 is fitted to an inner periphery of the upper recess 15 in such a way that an inner peripheral surface of the ring member 17 forms the inner peripheral surface 2*a* of the rotor chamber 2.

Although the rotor chamber 2 has a circular cross section when viewed in the thrust direction of the rotor 3, the inner peripheral surface 2*a* may be readily changed into an arbitrary shape such as an elliptical shape or the like when seen in the thrust direction of the rotor 3 by varying the shape of the inner peripheral shape of the inner circumference of the ring member 17. Further, formed in the upper case 11 are the inlet port 6 through which the working fluid is drawn into the working compartments 5 and the outlet port 7 through which the working fluid is discharged from the working compartments 5. The inlet port 6 and the outlet port 7 are in communication with the rotor chamber 2, i.e., the working compartments 5, via though-holes 17*a*. At a lower part of the lower case 12, there is arranged a stator 23 near an inner bottom surface of the lower recess 16.

The rotor 3 has a central bearing portion 18 and is formed into a circular shape when seen in the thrust direction. A plurality of (four, in the present embodiment) vane grooves 19 are radially formed in an upper portion of the rotor 3 and a magnetic body 22 made of magnet is integrally attached to a lower portion of the rotor 3. In the outer peripheral end portion of a thrust surface of the rotor 3 (a top surface 3*b* of the rotor 3), a sliding contact protrusion 8 is formed throughout the peripheral length excepting the vane grooves 19.

The bearing portion 18 of the rotor 3 is rotatably fitted to a rotating shaft 20 vertically extending through the rotor chamber 2, whereby the rotor 3 is rotatably arranged within the rotor chamber 2 in such a fashion that the outer peripheral surface 3*a* of the rotor 3 faces the inner peripheral surface 2*a* of the rotor chamber 2 and the thrust surface (top surface 3*b*) of the rotor 3 faces an inner ceiling surface 2*b* of the rotor chamber 2, which is a bottom surface of the upper recess 15. The rotating shaft 20 is non-rotatably secured to shaft fixing portions 21 provided at an off-centered position of the inner ceiling surface 2*b* of the rotor chamber 2 and a central position of the inner bottom surface of the lower recess 16.

The vanes 4 are inserted into the respective vane grooves 19 of the rotor 3 so that the vanes 4 can slidably move in the radial direction of the rotor 3. Thus, the respective vanes 4 are free to protrude above and retreat below the outer peripheral surface 3*a* of the rotor 3. On the top surface of a leading end portion of each of the vanes 4, a sliding contact protrusion 24 that makes contact with the inner ceiling surface 2*b* of the rotor chamber 2 at its top surface is formed to protrude upwardly over an extent greater than the maximum radial protruding length of each of the vanes 4 from the outer peripheral surface 3*a* of the rotor 3.

The magnetic body 22 and the stator 23 are placed adjacent to other when the rotor 3 is arranged in the rotor chamber 2. The magnetic body 22 and the stator 23 constitute a driving part for rotationally driving the rotor 3 in one direction as indicated by an arrow "a" in FIG. 1. In other words, when an electric current is inputted to the stator 23 from a power source (not shown), the driving part generates a torque by the magnetic interaction between the stator 23 and the magnetic body 22. The magnetic body 22 and the rotor 3 are rotatably driven by the torque thus generated.

In a state that the rotor 3 is arranged in the rotor chamber 2, the protruded end surface of the sliding contact protrusion 8 of the rotor 3 and the protruded end surface of the sliding contact protrusion 24 of each of the vanes 4 are adapted to make sliding contact with the inner ceiling surface 2*b* of the rotor chamber 2 that faces the top surface 3*b* of the rotor 3. Thus, the working fluid within the respective working compartments 5 is prevented from leaking through the gap between the thrust surface of the rotor 3 and the inner ceiling surface 2*b* of the rotor chamber 2.

As the rotor 3 accommodated in the rotor chamber 2 is rotatably driven by the driving part, the respective vanes 4 are protruded radially outward from the outer peripheral surface 3*a* of the rotor 3 under the influence of a centrifugal force exerted by rotation of the rotor 3. Therefore, the leading ends of the vanes 4 can make sliding contact with the inner peripheral surface 2*a* of the rotor chamber 2. Thus, the rotor chamber 2 is divided into a plurality of the working compartments 5, each of which is surrounded by the inner surfaces (the inner peripheral surface 2*a*, the inner ceiling surface 2*b*, etc.) of the rotor chamber 2, the outer peripheral surface 3*a* of the rotor 3 and the vanes 4. Since the rotor 3 is arranged at an eccentric position in the rotor chamber 2, the distance between the inner peripheral surface 2*a* of the rotor chamber 2 and the outer peripheral surface 3*a* of the rotor 3 varies with the angular positions of the rotor 3 and, similarly, the protruding amount of the vanes 4 relative to the rotor 3 varies depending on the angular positions of the rotor 3.

In other words, the rotation of the rotor 3 moves the respective working compartments 5 in the rotating direction of the rotor 3, during which time the volume of each working compartment 5 is varied between its lower and upper limits. That is, when each of the working compartments 5 is positioned to communicate with the inlet port 6, the volume thereof is increased with the rotation of the rotor 3. When each of the working compartments 5 is positioned to communicate with the outlet port 7, the volume thereof is reduced with the rotation of the rotor 3. Therefore, if the rotor 3 is rotatably driven, the working fluid is drawn into the working compartment 5 communicating with the inlet port 6 and then is pressurized in the working compartment 5, to thereby discharge the working fluid through the outlet port 7. This realizes the function of a pump.

Figure 4:
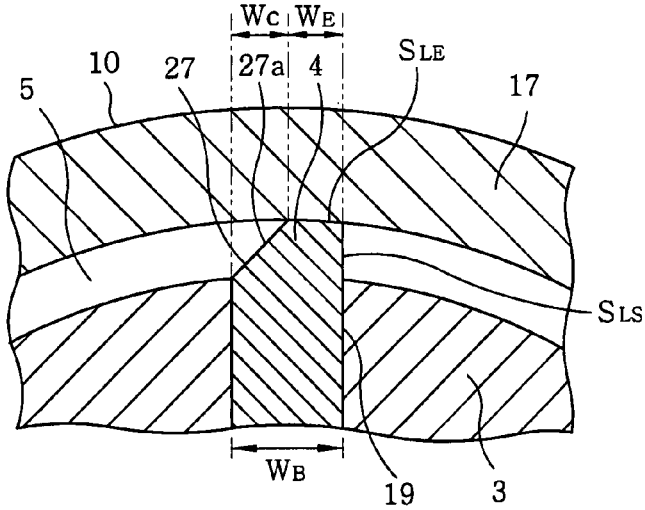
FIG. 4 is a partially enlarged horizontal cross sectional view of the vane pump shown in FIG. 1.

As can be shown in FIG. 4, in the vane pump 1 in accordance with the embodiment of the present invention, a cutout portion 27 is formed only on the trailing side of the leading end portion of each of the vanes 4, among the leading side of the rotating direction (the side of the leading end portion indicated by an arrow "a" in FIG. 1) and the trailing side (the side of the leading end portion indicated by an arrow "b" in FIG. 1). Therefore, the leading end can be made smaller in circumferential width than the base end portion of each of the vanes 4, the circumferential width W being a width in a direction perpendicular to both of the protruding direction of each of the vanes 4 and the thrust direction of the rotor 3 with such a configuration. The circumferential width $W_c$ of the cutout portion 27 may be preferably made greater than that of leading end so that the width of leading end is less than a half of the width of the base end portion of each of the vanes 4.|[csl1]

The leading end portion of each of the vanes 4 as viewed in the rotating direction of the rotor 3 is cut into a slant surface defining a periphery of the cutout portion 27. In the illustrated embodiment, the cutout portion 27 is formed by cutting the trailing side surface of the leading end portion of each of the vanes 4 into a flat slant surface 27*a* so that, when viewed in the thrust direction of the rotor 3, the flat slant surface 27*a* extends toward the base end of each of the vanes 4 but outwardly in the width direction of each of the vanes 4 (the direction perpendicular to the protruding direction of each of the vanes 4 when viewed in the thrust direction of the rotor 3).

That is, the flat slant surface 27*a* is parallel to the thrust direction and is inclined against the protruding direction of each of the vanes 4 while being contiguous to the leading end surface $S_{LE}$ thereof. The leading end surface $S_{LE}$ of each of the vanes 4 in sliding contact with the inner peripheral surface 2*a* of the rotor chamber 2 at the leading side portion of each of the vanes as viewed in the rotating direction of the rotor 3 remains perpendicular to the protruding direction of each of the vanes 4. Furthermore, the leading side surface $S_{Ls}$ of each of the vanes 4 as viewed in the rotating direction of the rotor 3 is kept perpendicular to the width direction of each of the vanes 4.

By forming the cutout portion 27 in the leading end portion of each of the vanes 4 to make the leading end smaller in width than the cutout portion 27 and the base end portion of the corresponding vane 4, it is possible to increase the width $W_B$ of the base end portion of each of the vanes 4 which is slidably received in each of the vane grooves 19. This makes it possible to increase the strength of the vanes 4 and to make the vanes 4 less susceptible to a dimensional error of themselves and the vane grooves 19, thereby assuring stable movement of the vanes 4 in the radial direction of the rotor 3. Furthermore, the leading end of each of the vanes 4 having a reduced width $W_E$ can be brought into close contact with the inner peripheral surface 2*a* of the rotor chamber 2 having a circular cross section, which helps improve pump efficiency.

In the embodiment set forth above, the cutout portion 27 is formed only on the trailing side of the leading end portion of each of the vanes 4. However, the cutout portion 27 may be formed only on the leading side or both on the leading and the trailing side of the leading end portion of each of the vanes 4.

Furthermore, in the embodiment shown in FIG. 4, the cutout portion 27 of each of the vanes 4 is formed by cutting the leading end portion of each of the vanes 4 into the flat slant surface 27*a*. However, the cutout portion 27 may be formed by cutting the leading end portion of each of the vanes 4 into a smoothly curved surface (not shown) so that the smoothly curved surface can extend toward the base end of each of the vanes 4 but outwardly in the width direction of each of the vanes 4 when viewed in the thrust direction of the rotor 3. In this case also, the smoothly curved surface may be preferably contiguous to the leading end surface $S_{LE}$ and is parallel to the thrust direction.

Figure 5:
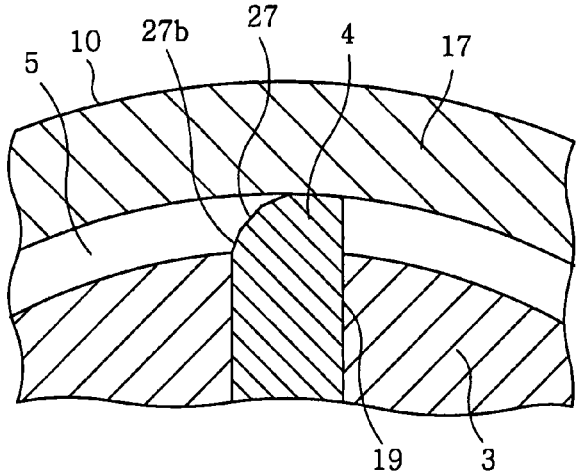
FIG. 5 is a partially enlarged horizontal cross sectional view showing a vane pump in accordance with another embodiment of the present invention.

As illustrated in FIG. 5, the cutout portion 27 of each of the vanes 4 may also be formed of a plurality of small slant surfaces 27*b* arranged parallel to the thrust direction of the rotor 3. The small slant surfaces 27*b* are inclined so that each of the small slant surfaces 27*b* can extend toward the base end of each of the vanes 4 but outwardly in the width direction of each of the vanes 4 when viewed in the thrust direction of the rotor 3. The small slant surfaces 27*b* are formed in such a fashion that the closer to the leading end of each of the vanes 4 the small slant surfaces 27*b* lie, the greater inclination angle the small slant surfaces 27*b* make with respect to the protruding direction of each of the vanes 4. That is, the small slant surface 27*b* disposed closer to the base end of each of the vanes 4 is more parallel to the protruding direction thereof.

Figure 6:
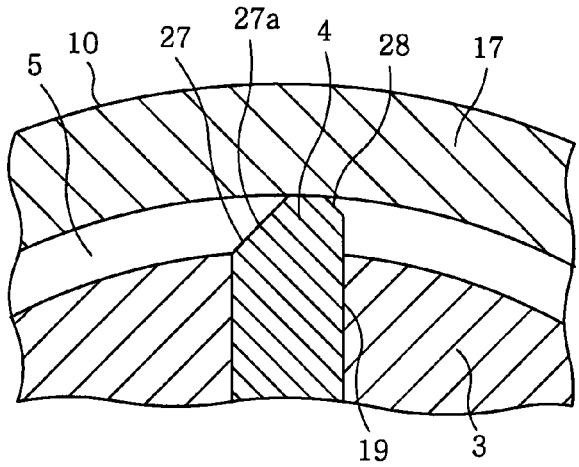
FIG. 6 is a partially enlarged horizontal cross sectional view showing a vane pump in accordance with still another embodiment of the present invention.

In case the cutout portion 27 is formed only on the trailing side of the leading end portion of each of the vanes 4 as shown in FIGS. 4 and 5, it is preferable that the leading side end corner of each of the vanes 4 as viewed in the rotating direction of the rotor 3 is chamfered to form a beveled portion 28, as illustrated in FIG. 6. In the illustrated embodiment, the base end side edge of the beveled portion 28 lies closer to the leading end of each of the vanes 4 than does the base end side edge of the cutout portion 28. As in the cutout portion 27, the beveled portion 28 may be of either a flat slant surface or a curved surface. By chamfering the leading side end corner of each of the vanes 4 as viewed in the rotating direction of the rotor 3 to form the beveled portion 28 in this way, it is possible to further reduce the width $W_E$ of the leading end of each of the vanes 4. This makes it possible to bring the leading end of each of the vanes 4 into closer sliding contact with the inner peripheral surface 2*a* of the rotor chamber 2 having a circular cross section and also to reduce the resistance against sliding movement of each of the vanes 4.

Figure 8:
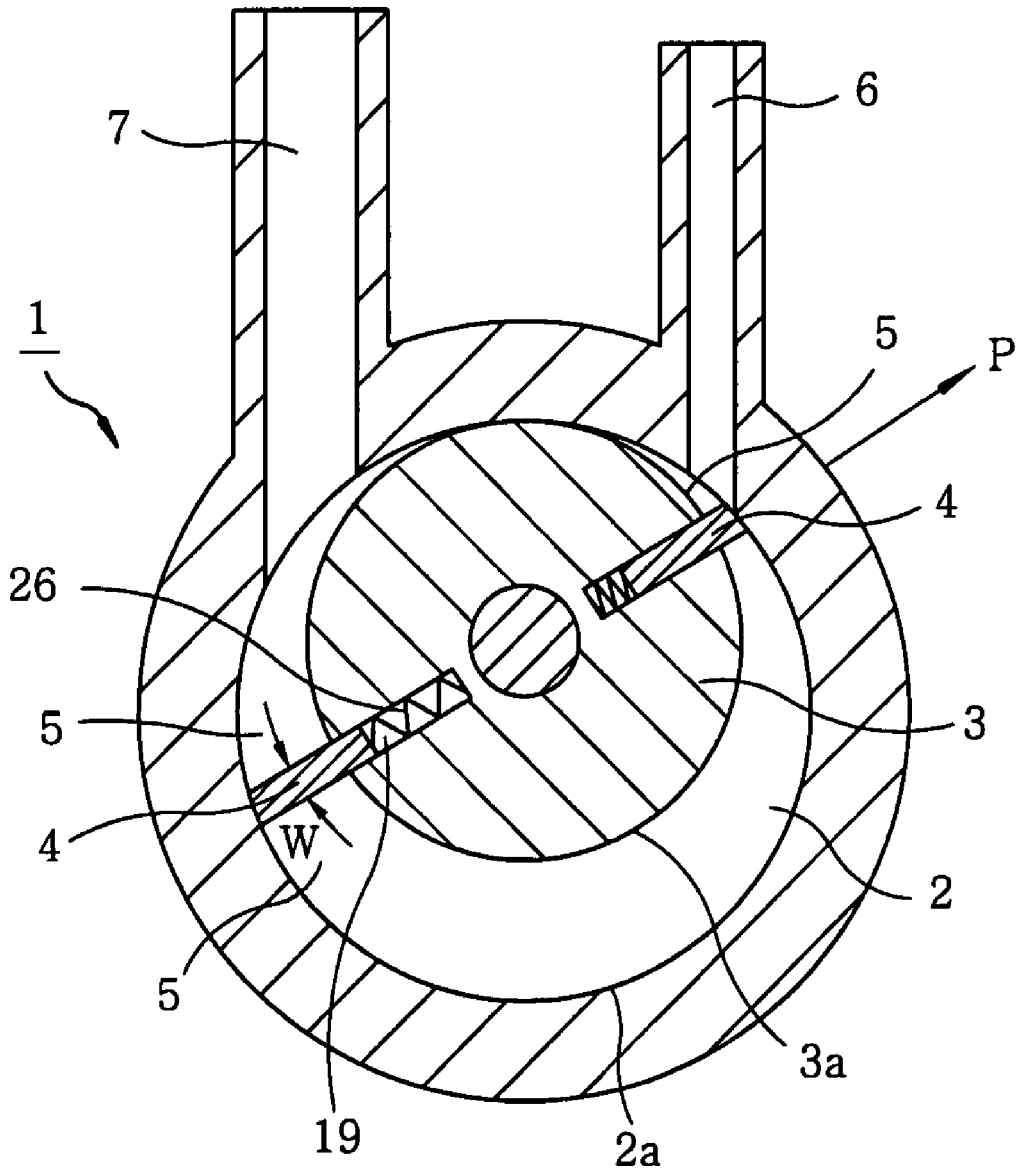
FIG. 8 (PRIOR ART)
FIG. 8 is a cross sectional view showing a prior art vane pump.

In the respective embodiments described above, the vanes 4 are protruded outwardly by the centrifugal force exerted by the rotation of the rotor 3. However, spring members 26 (see FIG. 8) that outwardly bias the vanes 4 may be inserted into the vane grooves 19 to ensure that the leading ends of the vanes 4 can make reliable sliding contact with the inner peripheral surface 2*a* of the rotor chamber 2 without resort to the rotating speed of the rotor 3.

Figure 7A:
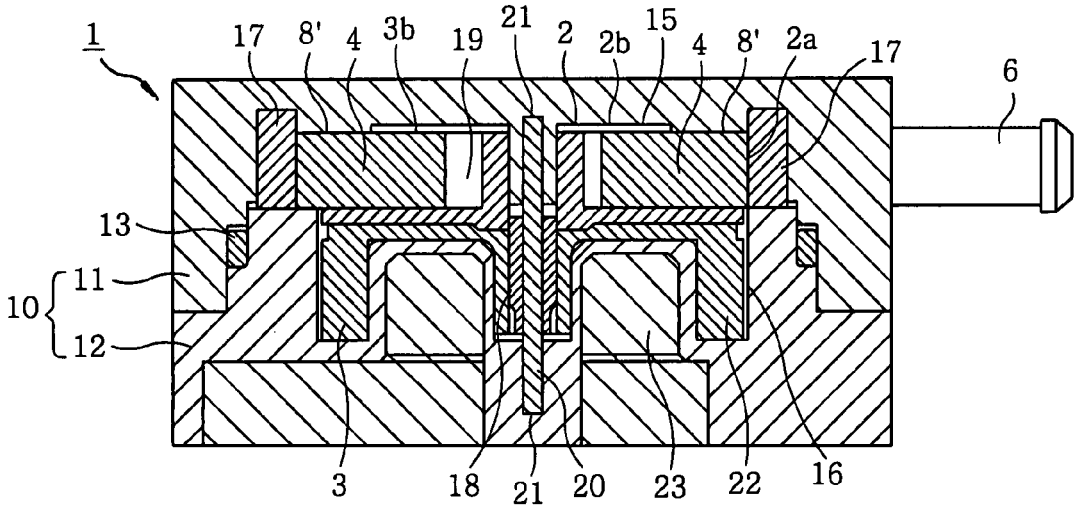
FIGS. 7A and 7B are cross sectional views of a vane pump in accordance with a further embodiment of the present invention, wherein FIG. 7A corresponds to the cross section taken along the line A-A in FIG. 1 and FIG. 7B corresponds to the cross section taken along the line B-B in FIG. 1.
Figure 7B:
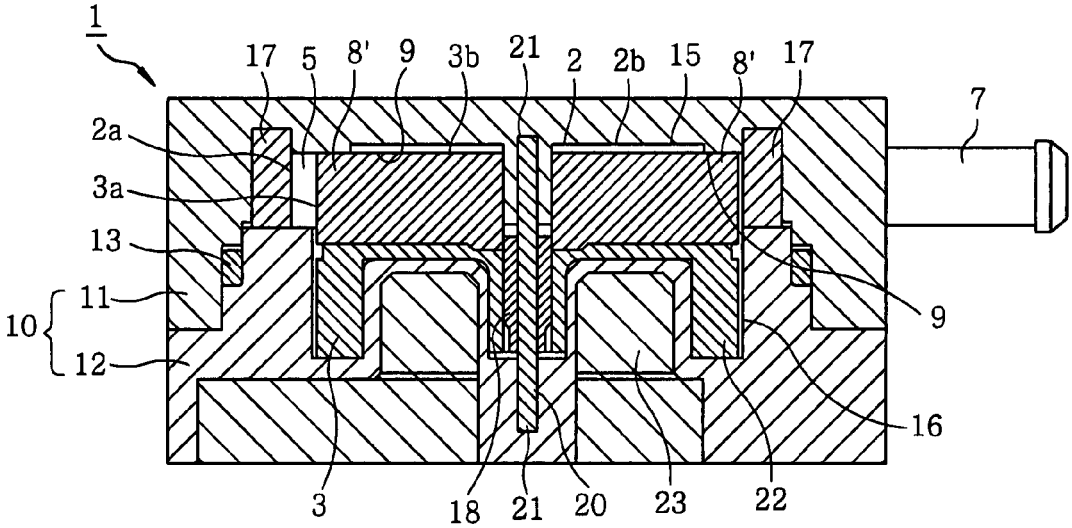

Furthermore, in the embodiments described above, the protruding end surface of the sliding contact protrusion 8 protruded in the peripheral end portion of the thrust surface of the rotor 3 and protruding the end surface of the sliding contact protrusion 24 of each of the vanes 4 are adapted to make sliding contact with the flat ceiling surface 2*b* of the rotor chamber 2. However, the means for bringing the thrust surface of the rotor 3 into sliding contact with the ceiling surface 2*b* of the rotor chamber 2 is not limited thereto. For example, as shown in FIGS. 7A and 7B, the thrust surface of the rotor 3 and the top surfaces of the vanes 4 may be made flat, and a sliding contact protrusion 8' may be formed on the ceiling surface 2*b* of the rotor chamber 2 in alignment with the trajectory of the peripheral end portion of the thrust surface of the rotor 3 and the vanes 4 so that the protruding end surface of sliding contact protrusion 8' can make sliding contact with the peripheral end portion of the thrust surface of the rotor 3 and the vanes 4.

Moreover, in the embodiments described above, the driving part for rotatably driving the rotor 3 is formed of the stator 23 and the magnetic body 22 that magnetically interact with each other. However, it may be possible to employ, as the driving part, a structure in which a shaft fixed to the rotor 3 is rotatably driven by an electric motor. Further, the cutout portion 27 may be formed such that, when the vanes 4 are protruded farthest from the outer peripheral surface of the rotor 3, the base end side edge of the cutout portion 27 is positioned closer to the central shaft of the rotor 3 than is the outer peripheral surface of the rotor 3. Alternatively, the whole part of the cutout portion 27 may be positioned radially outwardly of the outer peripheral surface of the rotor 3 when the vanes 4 are protruded farthest from the outer peripheral surface of the rotor 3.

While the invention has been shown and described with respect to the embodiments, it will be understood by those skilled in the art that various changes and modification may be made without departing from the scope of the invention as defined in the following claims.

What is claimed is:

1. A vane pump, comprising:

a rotor chamber;

a rotor accommodated in the rotor chamber;

a plurality of vanes attached to the rotor, each of the vanes having a leading end adapted to make sliding contact with an inner peripheral surface of the rotor chamber;

working compartments surrounded by inner surfaces of the rotor chamber, an outer peripheral surface of the rotor and the vanes, the working compartments adapted to undergo a volume change as the rotor is rotatably driven;

an inlet port through which a working fluid is drawn into a working compartment whose volume is being increased; and an outlet port through which the working fluid is discharged from a working compartment whose volume is being decreased, wherein a cutout portion is formed in a leading end portion of each of the vanes on each of at least one of a leading and a trailing side of the leading end portion as viewed in a rotating direction of the rotor, the leading end of each of the vanes having a width smaller than that of a base end portion of each of the vanes, wherein the cutout portion includes a plurality of slant surfaces arranged parallel to a thrust direction of the rotor, such that the closer to the leading end of each of the vanes the slant surfaces lie, the greater inclination angle the slant surfaces make with respect to a protruding direction of each of the vanes, wherein the cutout portion is formed only on the trailing side of the leading end portion of each of the vanes, and wherein each of the vanes has a beveled portion formed by chamfering a leading side end corner of each of the vanes as viewed in the rotating direction of the rotor.

2. The vane pump of claim 1, wherein the width of the leading end of each of the vanes has a width smaller than that of the cutout portion.

3. The vane pump of claim 1, wherein the cutout portion is of a flat slant surface or a smoothly curved surface.

4. The vane pump of claim 3, wherein the cutout portion is contiguous to the leading end and is parallel to a thrust direction of the rotor.

* * * * *